US010283335B2

(12) United States Patent
Voinov et al.

(10) Patent No.: US 10,283,335 B2
(45) Date of Patent: May 7, 2019

(54) REFLECTRON-ELECTROMAGNETOSTATIC CELL FOR ECD FRAGMENTATION IN MASS SPECTROMETERS

(71) Applicant: e-MSion, Inc., Corvallis, OH (US)

(72) Inventors: Valery G. Voinov, Corvallis, OR (US); Charles Otis, Corvallis, OR (US); Joseph S. Beckman, Corvallis, OR (US); Yury Vasil'ev, Corvallis, OR (US)

(73) Assignee: E-MSION, INC., Corvallis, OR (US)

( * ) Notice: Subject to any disclaimer, the term of this patent is extended or adjusted under 35 U.S.C. 154(b) by 0 days.

(21) Appl. No.: 15/612,195

(22) Filed: Jun. 2, 2017

(65) Prior Publication Data

US 2017/0352526 A1 Dec. 7, 2017

Related U.S. Application Data

(60) Provisional application No. 62/345,307, filed on Jun. 3, 2016.

(51) Int. Cl.

| | |
|---|---|
| ***H01J 49/00*** | (2006.01) |
| ***G21K 1/093*** | (2006.01) |
| ***G21K 1/087*** | (2006.01) |

(52) U.S. Cl.

CPC ..... *H01J 49/0054* (2013.01); *G21K 1/087* (2013.01); *G21K 1/093* (2013.01)

(58) Field of Classification Search

CPC ..... H01J 49/0054

See application file for complete search history.

(56) References Cited

U.S. PATENT DOCUMENTS

| | | | | |
|---|---|---|---|---|
| 6,013,913 | A * | 1/2000 | Hanson | H01J 49/406 250/282 |
| 8,723,113 | B2 | 5/2014 | Barofsky et al. | |
| 8,735,810 | B1 * | 5/2014 | Vestal | H01J 49/025 250/281 |
| 9,305,760 | B2 | 4/2016 | Barofsky et al. | |
| 2003/0183760 | A1 * | 10/2003 | Tsybin | H01J 49/0054 250/292 |
| 2004/0245448 | A1 * | 12/2004 | Glish | H01J 49/0054 250/281 |
| 2007/0023648 | A1 * | 2/2007 | Baba | H01J 49/0095 250/294 |
| 2007/0029473 | A1 * | 2/2007 | Verentchikov | H01J 49/406 250/281 |
| 2007/0221862 | A1 * | 9/2007 | Suits | H01J 49/0054 250/427 |

(Continued)

OTHER PUBLICATIONS

Michalski et al., "More than 100,000 detectable peptide species elute in single shotgun proteomics runs but the majority is inaccessible to data-dependent LC-MS/MS," J Proteome Res. Apr. 1, 2011;10(4):1785-93. doi: 10.1021/pr101060v. Epub Feb. 28, 2011.

(Continued)

*Primary Examiner* — Michael J Logie

(74) *Attorney, Agent, or Firm* — SmithAmundsen LLC; Jennifer Lacroix

(57) ABSTRACT

Reflectron-electromagnetostatic cells for use in mass spectrometers are provided herein that cause ion packets to pass through the cell a plurality of times during fragmentation.

13 Claims, 15 Drawing Sheets

(56) References Cited

U.S. PATENT DOCUMENTS

| | | | | |
|---|---|---|---|---|
| 2008/0203885 | A1* | 8/2008 | Ono | H01J 1/16 313/310 |
| 2008/0224033 | A1* | 9/2008 | Makarov | H01J 49/004 250/287 |
| 2009/0173877 | A1* | 7/2009 | Bateman | G01N 27/622 250/282 |
| 2009/0294661 | A1* | 12/2009 | Hashimoto | H01J 49/4295 250/290 |
| 2010/0181471 | A1* | 7/2010 | Pop | G01V 9/00 250/254 |
| 2011/0233397 | A1* | 9/2011 | Barofsky | H01J 49/062 250/294 |
| 2013/0168547 | A1* | 7/2013 | Nishiguchi | H01J 49/405 250/287 |
| 2016/0126076 | A1* | 5/2016 | Baba | H01J 49/063 250/489 |

OTHER PUBLICATIONS

Palumbo et al., "Tandem mass spectrometry strategies for phosphoproteome analysis," Mass Spectrom Rev. Jul-Aug. 2011;30(4):600-25. doi: 10.1002/mas.20310. Epub Feb. 3, 2011.

Qi et al., "Structural analysis of small to medium-sized molecules by mass spectrometry after electron-ion fragmentation (ExD) reactions," Analyst. Feb. 7, 2016;141(3):794-806. doi: 10.1039/c5an02171e. Epub Jan. 4, 2016.

Voinov et al., "Electron-capture dissociation (ECD), collision-induced dissociation (CID) and ECD/CID in a linear radio-frequency-free magnetic cell," Rapid Commun Mass Spectrom. Sep. 2009; 23(18): 3028-3030.

Voinov et al., "ECD of Tyrosine Phosphorylation in a Triple Quadrupole Mass Spectrometer with a Radio-Frequency-Free Electromagnetostatic Cell," Journal of the American Society for Mass Spectrometry. Oct. 2014, vol. 25, Issue 10, pp. 1730-1738.

Voinov et al., "Electron Capture, Collision-Induced, and Electron Capture-Collision Induced Dissociation in Q-TOF," Journal of the American Society for Mass Spectrometry. Apr. 2011, vol. 22, Issue 4, pp. 607-611.

Voinov et al., "Electron Capture Dissociation of Sodium-Adducted Peptides on a Modified Quadrupole/Time-of-Flight Mass Spectrometer," J Am Soc Mass Spectrom. Dec. 2015;26(12):2096-104. doi: 10.1007/s13361-015-1230-y. Epub Aug. 13, 2015.

Zubarev, 2004. "Electron-capture dissociation tandem mass spectrometry," Current Opinion in Biotechnology. vol. 15, Issue 1, Feb. 2004; 12-16.

Zubarev et al., "Towards an Understanding of the Mechanism of Electron-Capture Dissociation: A Historical Perspective and Modern Ideas," European Journal of Mass Spectrometry. vol. 8, Issue 5, pp. 337-349. First Published Oct. 1, 2002.

Zubarev et al., "Electron capture dissociation of Multiply Charged Protein Cations. A nonergodic process," J. Am. Chem. Soc. 1998. 120, 3265-3266.

Zubarev et al., "Electron capture dissociation for structural characterization of multiply charged protein cations," Anal Chem. Feb. 1, 2000;72(3):563-73.

* cited by examiner

REFLECTRON-ELECTROMAGNETOSTATIC CELL FOR ECD FRAGMENTATION IN MASS SPECTROMETERS

RELATED APPLICATIONS

This application claims priority to U.S. Provisional Application Ser. No. 62/345,307, filed Jun. 3, 2016, the contents of which are hereby incorporated by reference in their entirety.

BACKGROUND

Mass spectrometry has risen to prominence in the life sciences because it is indispensable for identifying and quantifying structural and functional modifications to proteins. However, only a small fraction of the information potentially available can be accessed by current instruments. In high-throughput, bottom-up proteomics experiments, only about 16% of peptides are identifiable with the best currently available technology.

The speed, resolution and high mass accuracy of modern mass spectrometers have revolutionized many fields, such as proteomics, for example to determine the location of fragile post-translational modifications that control most cellular processes. However, accurate identification and quantitation of phosphorylation sites remain a major challenge in proteomics. The key weakness with mass spectrometry for phospho-proteomics lies in the methods used to induce fragmentation, because phosphoryl bonds are among the most labile chemical bonds in proteins and are lost in complex ways by current collision-based fragmentation approaches. An alternative fragmentation methodology called electron capture dissociation (ECD) is well established to produce exceptional spectra of phosphopeptides, but is currently feasible only in expensive FTICR mass spectrometers. The fundamental limitation to ECD is providing enough low-energy electrons to efficiently fragment peptides.

BRIEF DESCRIPTION OF SEVERAL VIEWS OF THE DRAWINGS

Specific examples have been chosen for purposes of illustration and description, and are shown in the accompanying drawings, forming a part of the specification.

DETAILED DESCRIPTION

Figure 1:
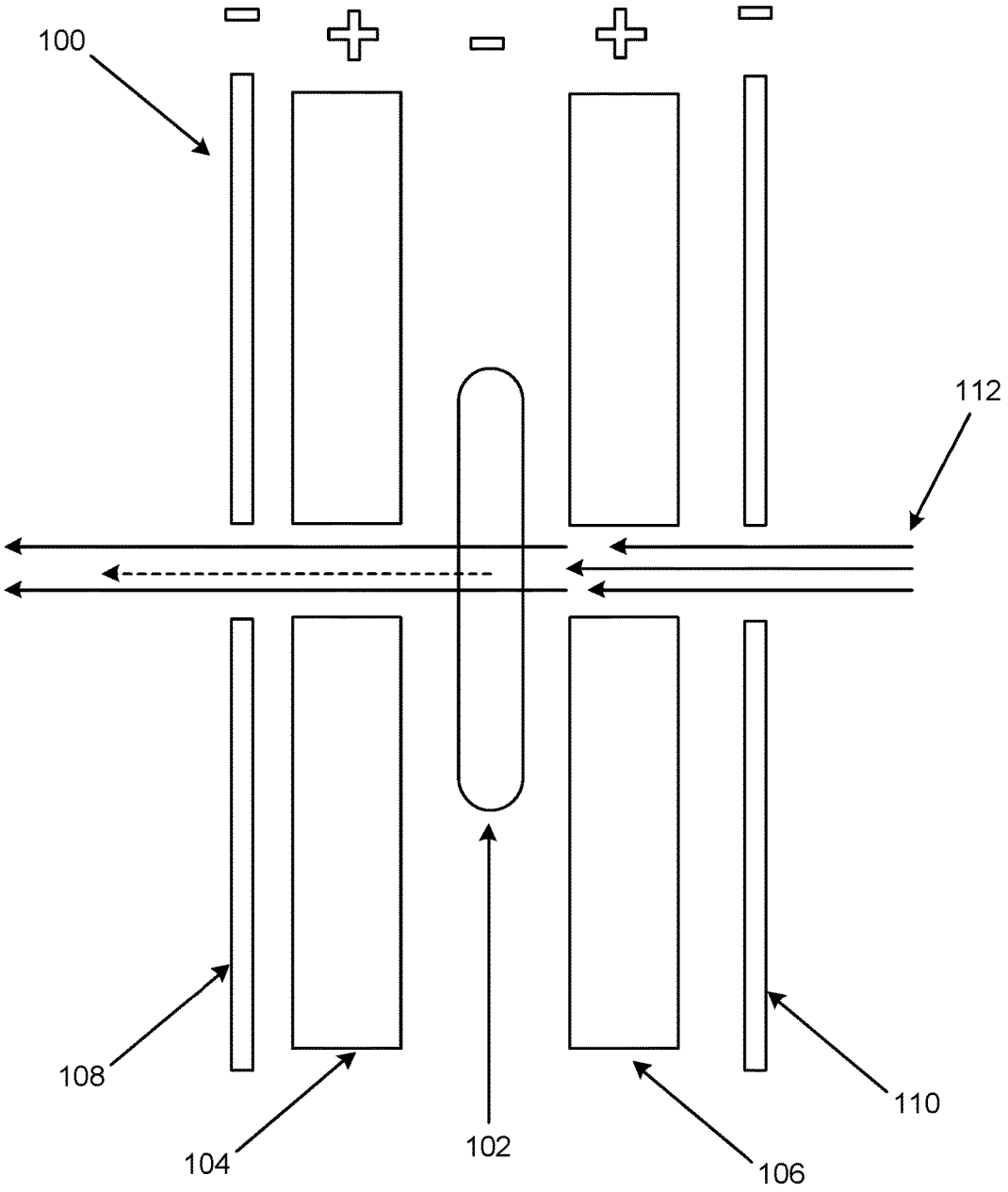
FIGURE 1 PRIOR ART
FIG. 1 illustrates a section view of a single pass ECD cell of the prior art.

FIG. 1 illustrates one example of a currently known single pass ECD cell, which uses elements disclosed in U.S. Pat. Nos. 8,723,113 and 9,305,760. The single pass ECD cell 100 has an electron emitting filament 102. Magnets 104 and 106 are located on either side of the electron emitting filament 102. End cap lenses 108 and 110 are located on the side of magnets 104 and 106, respectively, opposite electron emitting filament 102. End cap lenses 108 and 110 can be used to control the flow of electrons. In operation, the ion packet 112 passes through cell 100 a single time. One of the limitations of the single pass ECD cell 100 is that, for peptides containing two positive charges, which are commonly analyzed in proteomics, the efficiency is generally in the range of 5%. Only one in twenty peptides is fragmented, which limits sensitivity. The single pass ECD cell 100 is useful in many applications, but the efficiency of fragmentation, partially for small molecular ions with two or fewer positive charges could be improved.

Reflectron-electromagnetostatic cells of the present technology may increase the efficiency of fragmentation in mass spectrometers to improve the identification of both small molecules (e.g., drugs, metabolites, environmental chemicals) and large molecules (e.g., proteins, glycoproteins, lipids, DNA, RNA). FIGS. 2-9 illustrate some examples of reflectron-electromagnetostatic cells of the present technology, which cause an ion packet to pass through the cell multiple times. Reflectron-electromagnetostatic cells of the present technology differ from previously known ECD cells in several ways. For example, reflectron-electromagnetostatic cells of the present technology utilize the addition of ion control elements that cause ions to be reflected or slowed through the electromagnetostatic ECD cell. Such alteration of the flow path of ion packets in the cell may increase the efficiency of fragmentation by electron capture dissociation. The ion control elements may include at least one reflectron having at least one electrostatic element, and a controller that applies appropriate DC voltages to the electrostatic element in order to modulate the movement of the ions in the ion packets. A reflectron may include at least one electrostatic lens, or a plurality of electrostatic lenses. In such a reflectron, each electrostatic lens may be a metal disk, and may have an aperture of a desired size to allow the passage of ions in an ion packet to pass through the disk. Although specific numbers of lenses are shown for each reflectron in the illustrated examples, it should be understood that, generally, each reflectron may have at least one lens, and that the number of lenses may vary. A reflectron may also be substituted by an ion trap operated to cool and return ions through the ECD cell. Each reflectron may be maintained at an electrical potential sufficient to slow or reflect molecular ions as they pass through the ECD cell. A controller should be operable to adjust the DC voltage of any electrostatic element of a reflectron in the range of −100 to +100 volts on a minimum time scale of 1 microsecond.

Figure 2:
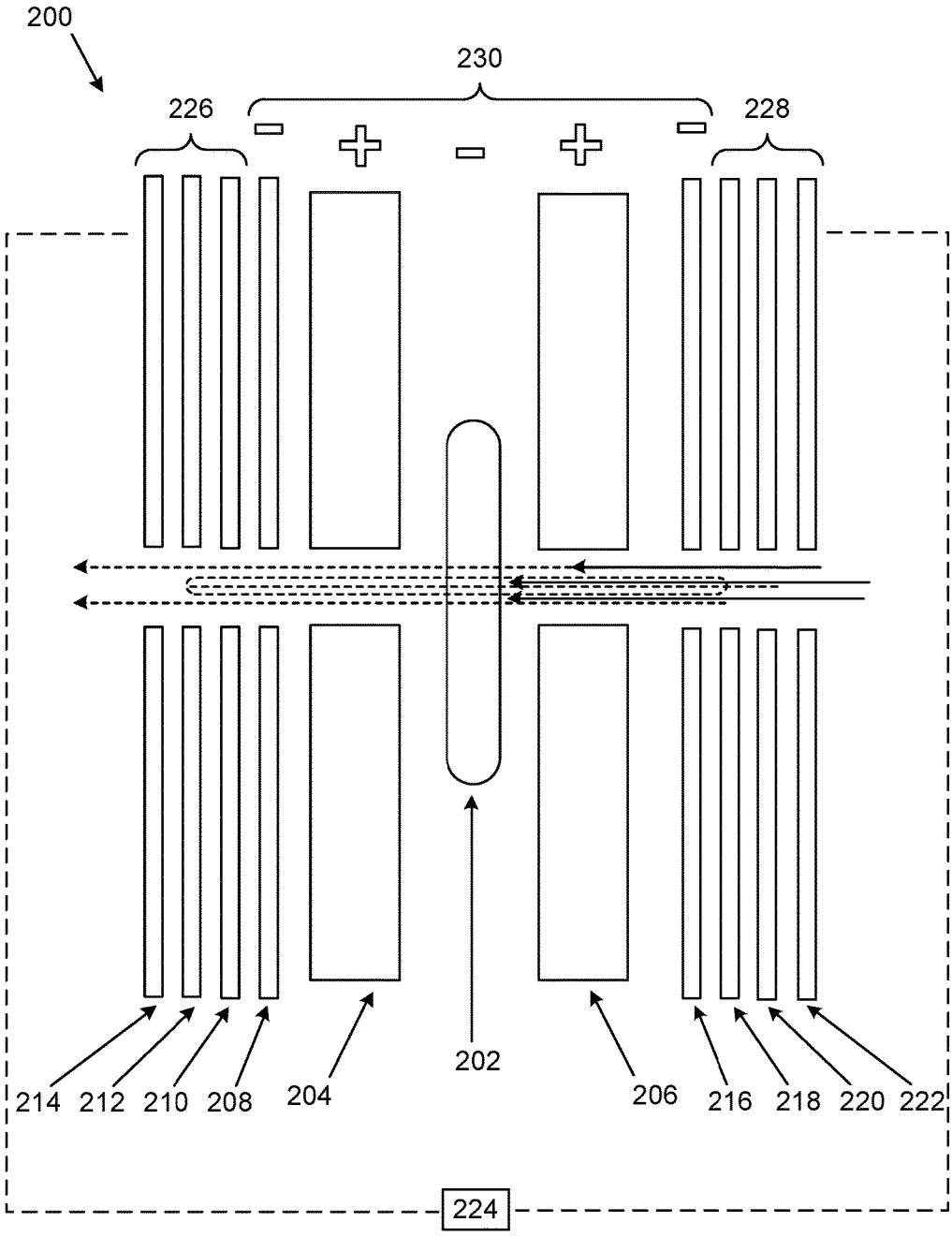
FIG. 2 illustrates a section view of one example of a reflectron-electromagnetostatic cell of the present technology.

As shown in FIG. 2, the reflectron-electromagnetostatic cell 200 has an ECD cell 230 and two reflectrons 226 and 228. The ECD cell 230 includes a thermo electron emitter, such as electron emitting filament 202. The electron emitting filament 202 may also generate infrared radiation that slightly heats molecular ions, which may help dissociate native proteins and large complexes of molecules held together by weak intermolecular interactions. This may improve the sensitivity and quality of mass spectra. Multiple passes through the filament as described here may increase the ability to dissociate native proteins and other molecular complexes. Magnets 204 and 206 are located on either side of the electron emitting filament 202. End cap lenses 208 and 216 are located on the outer sides of magnets 204, and 206, respectively, opposite the electron emitting filament 202. A reflectron is located on one side of each of the ECD cell 230, in each case on the side opposite electron emitting filament 202. As shown, a first reflectron 226 consists of lenses 210-214 located to the left of magnet 204, and a second reflectron 228 consists of lenses 218-222 located to the right of magnet 206. Each of the lenses 210-214 and 218-222 is operatively connected to a controller 224, which controls the voltage of each of the lenses, and can adjust the voltage in each lens.

Figure 3:
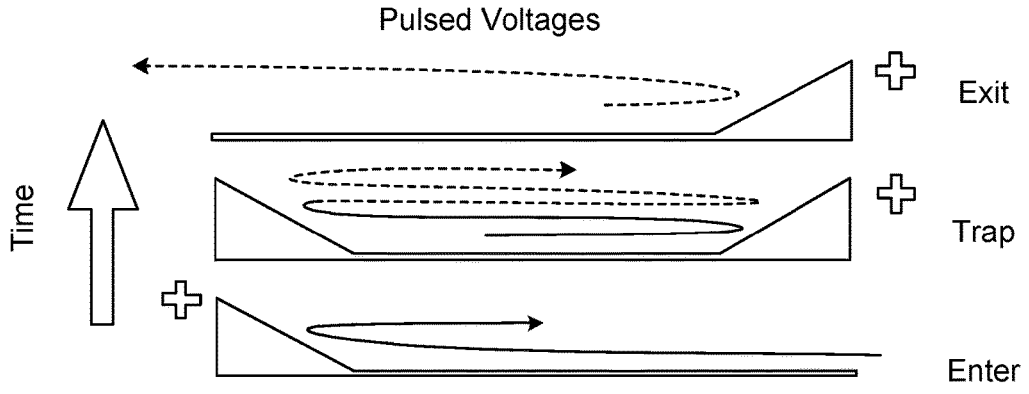
FIG. 3 illustrates the flow of ions through the example of FIG. 2.

The flow path of the ion packet 232 during operation of the reflectron-electromagnetostatic cell 200 is shown in FIGS. 2 and 3. The controller 224 establishes a voltage gradient and adjusts the voltage gradient over time, using pulsed voltages, to alter the flow path of the ion packet 232. For example, as shown, when the ion packet 232 enters and passes through the electron emitting filament 202 a first time, the controller 224 creates a voltage gradient in first reflectron 226 (lenses 208-214) that traps the ion packet 232 in the cell 200 and reflects the ion packet 232 back through the electron emitting filament 202 a second time. Then, likely within a few microseconds, the controller raises the voltages in the second reflectron 228 (lenses 216-222) to trap the ion packet 232 in the cell 200 and reflect the ion packet 232 back through the electron emitting filament 202 a third time. The ion packet 222 may be reflected by the first and second reflectrons back and forth through the electron emitting filament 202 a number of times. Finally, the controller lowers the voltages in first reflectron 226 (lenses 210-214) to allow the ion packet 232 to exit the cell 200.

Figure 4:
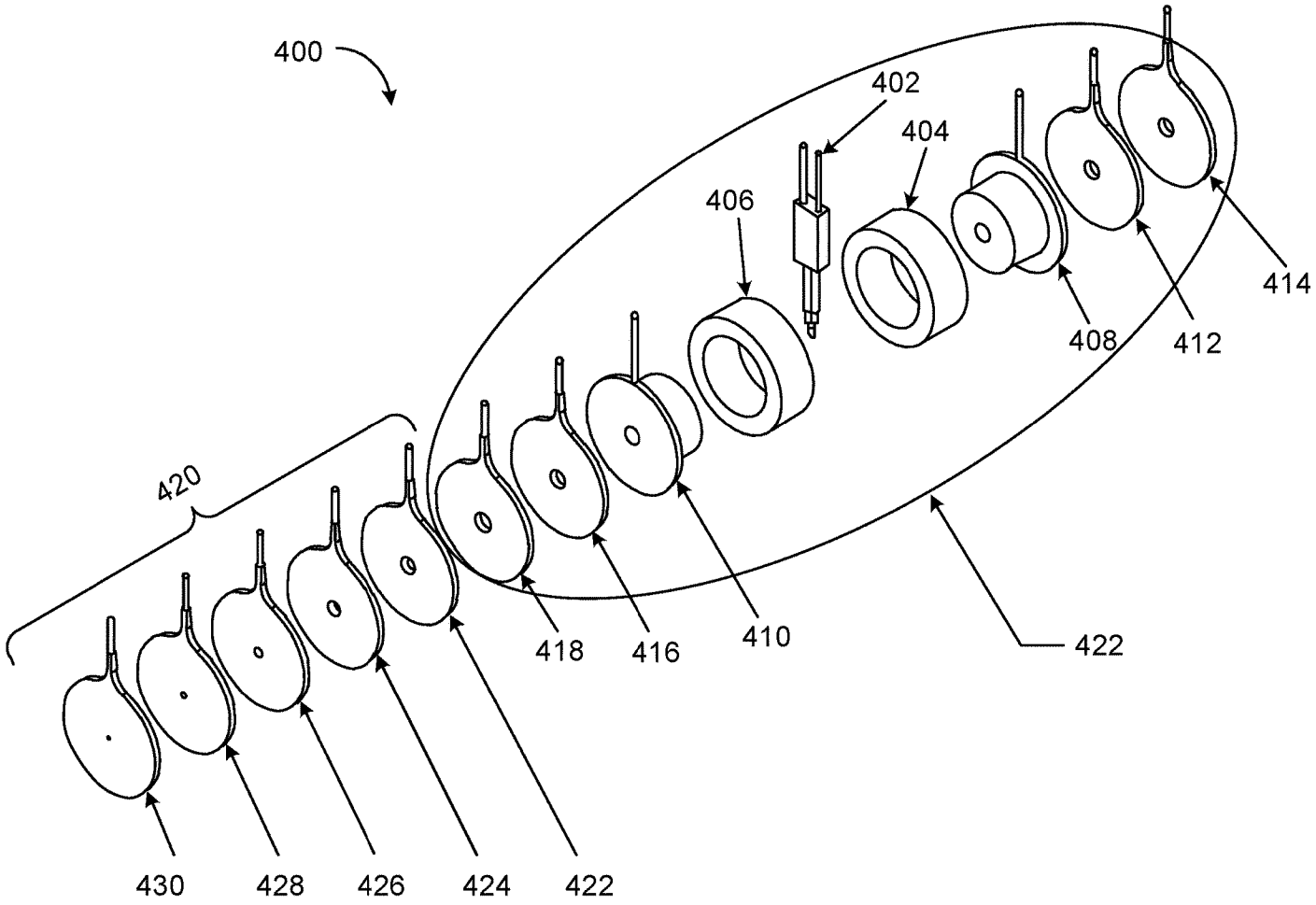
FIG. 4 illustrates an exploded view of a second example of a reflectron-electromagnetostatic cell of the present technology.

As shown in FIG. 4, reflectron-electromagnetostatic cell 400 includes an ECD cell 422 and reflectron 420. The ECD cell 422 includes electron emitting filament 402. Magnets 404 and 406, and magnet inserts 408 and 410, are located on either side of the electron emitting filament 402, respectively. End cap lenses 412 and 414 are located on the side of magnet 404 and magnet insert 408 opposite electron emitting filament 402. End cap lenses 414 and 416 are located on the side of magnet 406 and magnet insert 410 opposite electron emitting filament 402. A reflectron 420, consisting of a series of lenses 422-430, is located on the side of end cap 418 opposite the electron emitting filament 402. The reflectron may be operatively connected to a controller that adjusts the voltages of each of the lenses.

Figure 5:
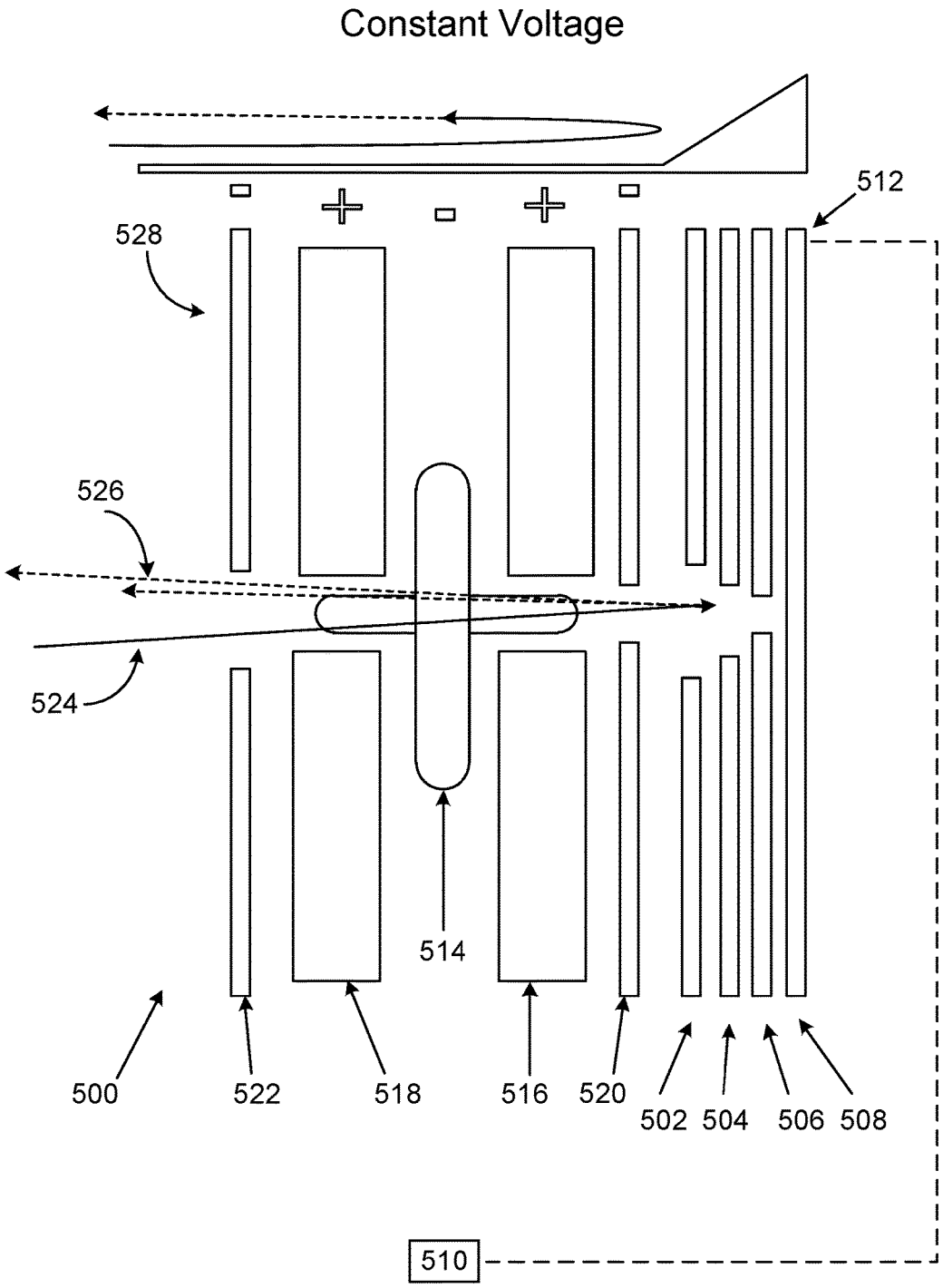
FIG. 5 illustrates a section view of a third example of a reflectron-electromagnetostatic cell of the present technology.

FIG. 5 illustrates reflectron-electromagnetostatic cell 500, which uses a reflectron 512 consisting of a series of lenses 502-508 with increasing positive voltage to reverse the course of ions back through an ECD cell 528. It is estimated that reflectron-electromagnetostatic cell 500 would at least double the efficiency of fragmentation as compared to single pass ECD cell 100. ECD cell 528 includes an electron emitting filament 514, a first magnet 516 on the right side of the electron emitting filament 514, a second magnet 518 on the left side of the electron emitting filament 514, a first end cap lens 520 on the right side of the first magnet 516 (the side opposite the electron emitting filament 514), a second end cap lens 522 on the left side of second magnet 518 (the side opposite the electron emitting filament 514). The ion packets entering the cell flow from left to right, as shown by arrow 524. The reflectron 512 stops the ion packets, preventing them from leaving the cell on the right side, and redirect the ion packets back through the electron emitting filament 514. Fragments leave the cell 500 in a flow path from right to left, as shown by arrow 526.

Each lens of the series of lenses 502-508 in the reflectron 512 is a metal disk. Each of the lenses is 502-508 connected to a DC power supply controller 510. Controller 510 provides each lens with a constant voltage of a desired amount. In this example, the constant voltage of each lens increases for each lens in the series from left to right, creating a progressively increasing series of constant voltages across the lenses 502-508. Thus, lens 504 has a higher voltage than lens 502, lens 506 has a higher voltage than lens 504, and lens 508 has a higher voltage than lens 506.

Another embodiment of this configuration includes placing the reflectron lens 512, or a series of lenses forming a reflectron, between the first magnet and the filament. In this way, ions would be reflected before entering the filament. The filament could then be made as a solid disk to allow more electrons to enter the ECD cell than possible from loop filaments used in the other embodiments of the invention In alternative embodiments, the electrostatic reflectron 512 of FIG. 5 could be used in the place of a classical reflectron in a Time of Flight (ToF) mass spectrometer. This may allow for efficient fragmentation by ECD. A pusher pulse could be applied to ions exiting the cell to initiate the separation of fragments.

Figure 6:
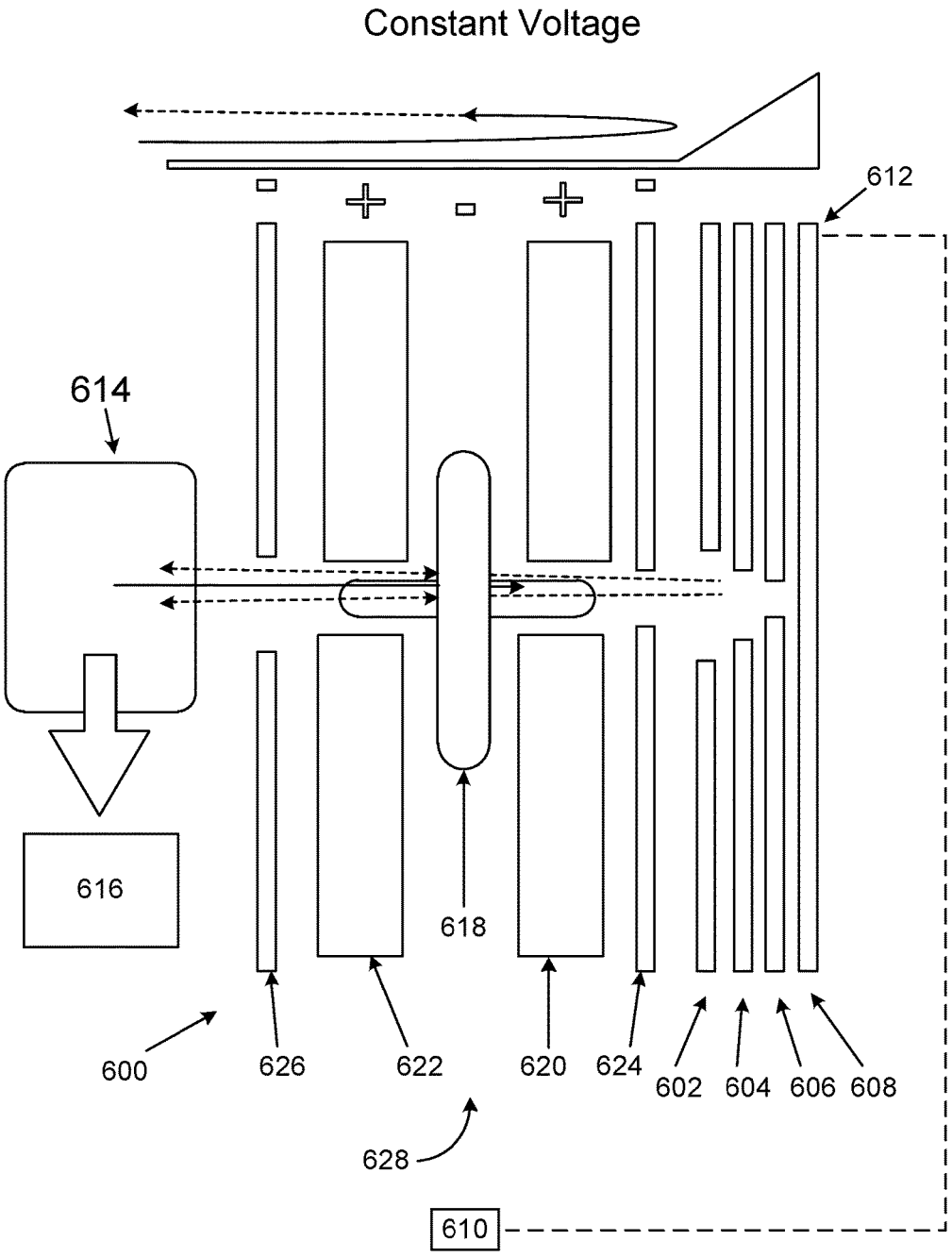
FIG. 6 illustrates a section view of a fourth example of a reflectron-electromagnetostatic cell of the present technology.

FIG. 6 illustrates reflectron-electromagnetostatic cell 600, which uses an reflectron 612 consisting of a series of lenses 602-608 with increasing positive voltage to reverse the course of ions back through the cell 600. Reflectron-electromagnetostatic cell 600 includes an ECD cell 628. ECD cell 628 includes electron emitting filament 618, a first magnet 620 on the right side of the electron emitting filament 618, a second magnet 622 on the left side of the electron emitting filament 618, a first end cap lens 624 on the right side of the first magnet 620 (the side opposite the electron emitting filament 628), a second end cap lens 626 on the left side of second magnet 622 (the side opposite the electron emitting filament 618), and reflectron 612.

Each lens in the series of lenses 602-608 is a metal disk connected to a DC power supply controller 610. The controller 610 provides a constant voltage to each lens, and can provide a progressively increasing series of constant voltages across the lenses 602-608. Thus, lens 604 has a higher voltage than lens 602, lens 606 has a higher voltage than lens 604, and lens 608 has a higher voltage than lens 606. The reflectron-electromagnetostatic cell 600 also includes an ion trap 614, which contains a cooling gas to trap ions before being sent through the reflectron-electromagnetostatic cell 600. Appropriate voltages can be applied to eject ions with low energy out of the ion trap 614, into the reflectron-electromagnetostatic cell 600 and then reflected back. Both the parent ions and the fragments are cooled on their return to the ion trap 614. By adjusting the length of time or by pulsing ions out of the ion trap 614, it is possible to make multiple passes of the ions to achieve the maximal degree of fragmentation desired within milliseconds. The ions can then be passed from the ion trap 614 in a different path for analysis of the fragmentation by a mass analyzer 616, such as an Orbitrap or ToF mass analyzer.

Figure 7:
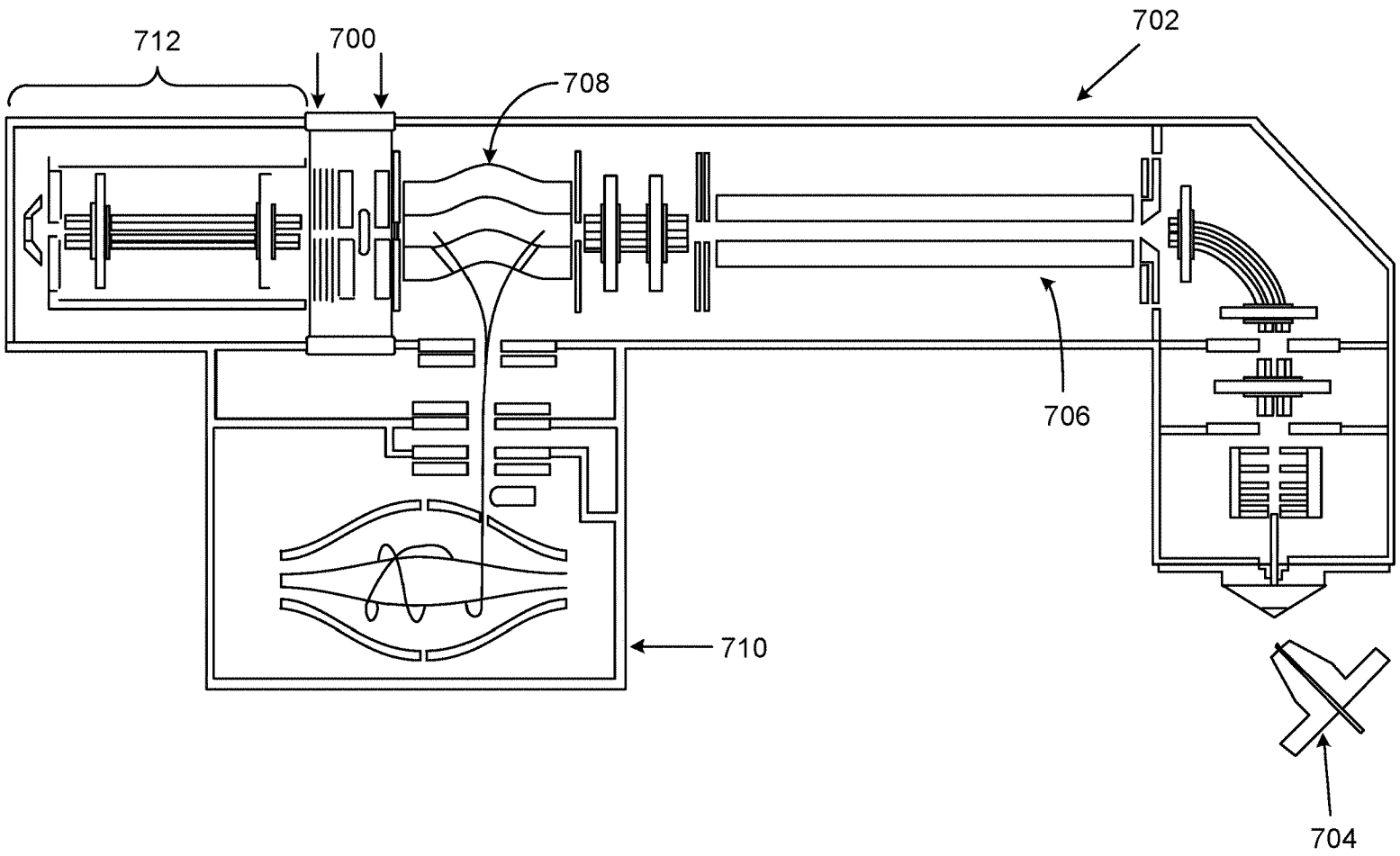
FIG. 7 illustrates a section view of a reflectron-electromagnetostatic cell of the present technology in a mass spectrometer.

FIG. 7 illustrates a reflectron-electromagnetostatic cell 700 of the present technology in a mass spectrometer 702 The direction of the flight path of the ion packets is from the right to the left, from the electro-spray ionization source 704, through the transfer optics 706, and then through the C-trap 708 before entering the reflectron-electromagnetostatic cell 700. The C-trap 708 is a specific type of ion trap used to squeeze ions into a tight ion packet before they are injected into the Orbitrap mass analyzer 710 for measuring molecular weights of the fragment ions. However, the ion packets may be first injected into a higher energy collision-induced dissociation (HCD) ion trap 702. Ions can be transferred into the HCD cell with energy ranging from 1-200 volts to fragment by collisions with gas molecules. Alternatively, ions can be passed through the reflectron-electromagnetostatic cell 700 only and are returned to the C-Trap without entering the HCD collision cell to produce an ECD spectrum. In addition, the ions can be dissociated by two processes simultaneously—by transferring to HCD cell with energy enough to fragment by CID process and by ECD process in reflectron-EMS cell. The ability to rapidly fragment molecular ions by two complementary methods that cause different forms of fragmentation can be extremely valuable for improving the identification of molecules by mass spectrometry.

Figure 8:
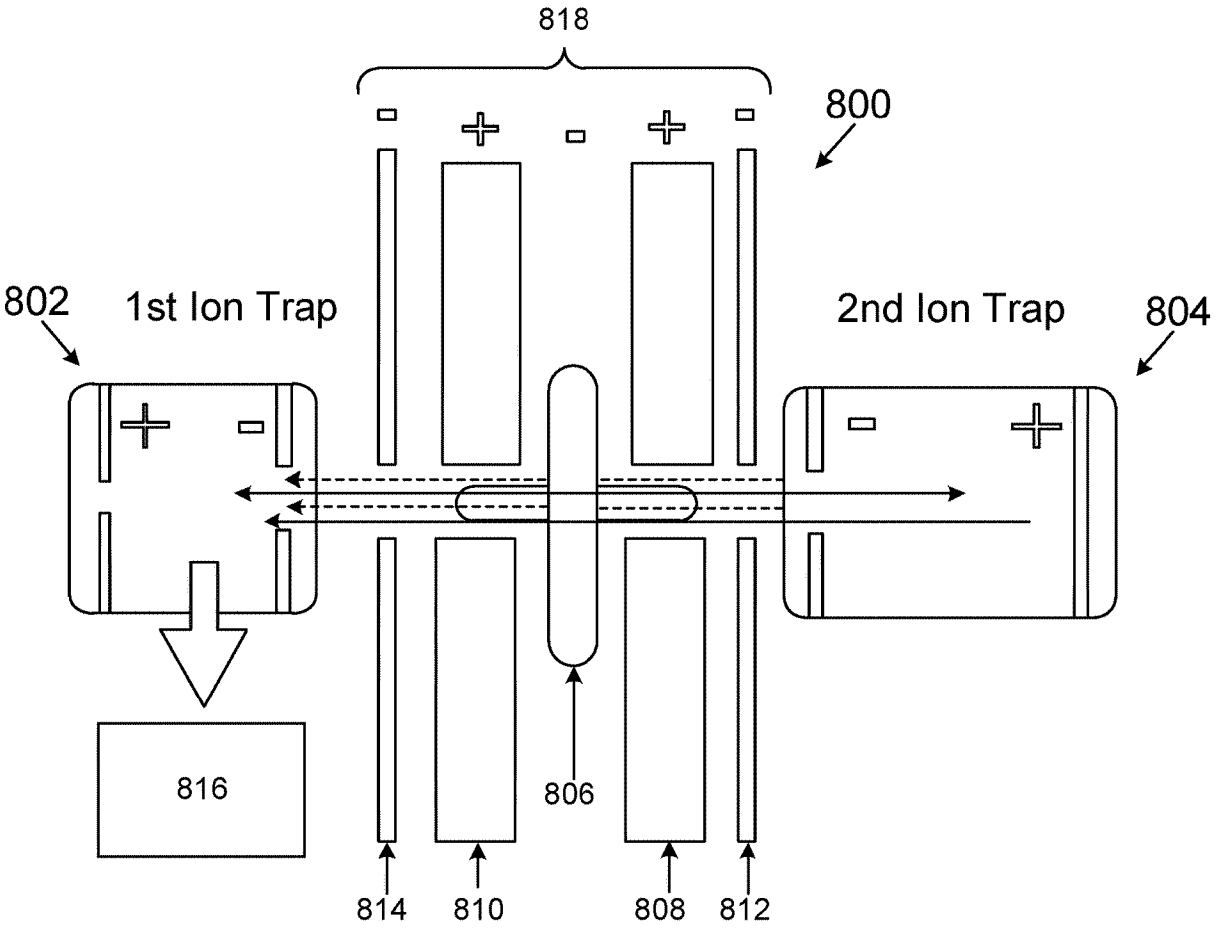
FIG. 8 illustrates a section view of a fifth example of a reflectron-electromagnetostatic cell of the present technology.

FIG. 8 illustrates a reflectron-electromagnetostatic cell 800 of the present technology, in which ions are passed through an ECD cell from two ion traps 802 and 804. In this example, each ion trap 802 and 804 functions as a reflectron, redirecting the ion packets back through the ECD cell 818. The ECD cell 818 includes an electron emitting filament 806, a first magnet 808 on the right side of the electron emitting filament 806, a second magnet 810 on the left side of the electron emitting filament 806, a first end cap lens 812 on the right side of the first magnet 808 (the side opposite the electron emitting filament 806), a second end cap lens 814 on the left side of second magnet 810 (the side opposite the electron emitting filament 806). Ions from the mass spectrometer source enter ion trap 802 from the left through a holed in the electrostatic plate. Each of the ion traps 802 and 804 has may or may not have a closed electrostatic end plate. Once ions have been trapped in ion trap 802, they may be electrostatically propelled through the ECD cell 800 by raising the overall potential. After passage through the ECD cells, ions may be reflected ions back through trap 804 by subsequently raising the DC electrostatic potentials on its end plates and trap elements. The voltages can be adjusted for the end plates within the ion traps to drive ions with a small amount of kinetic energy (e.g., 1-20 eV) between the ion traps through the cell 800. One application for reflectron-electromagnetostatic cell 800 would be for use instead of reflectron-electromagnetostatic cell 600 in mass spectrometer 700 of FIG. 7.

Figure 9:
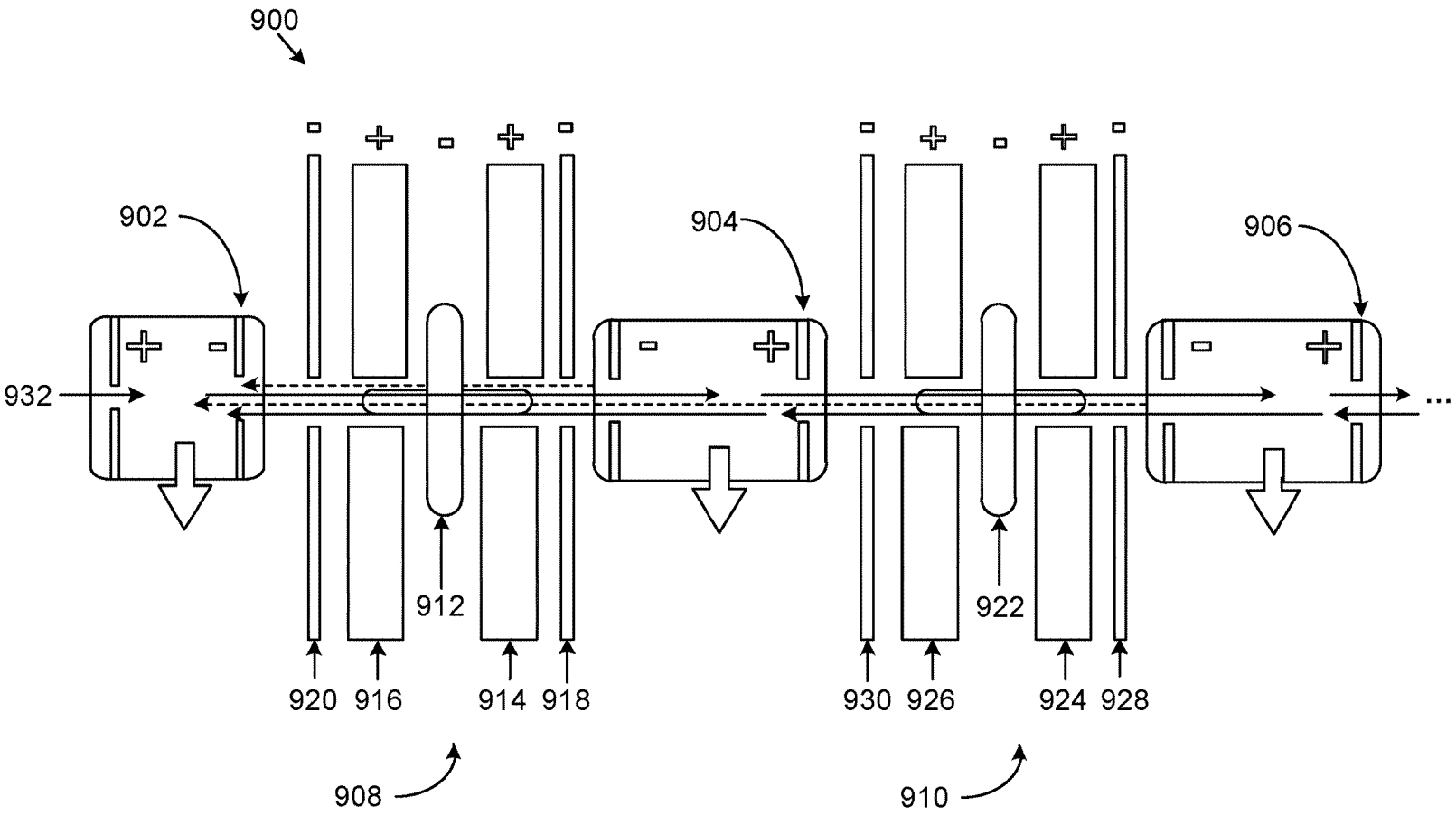
FIG. 9 illustrates a section view of a sixth example of the present technology, having a series of reflectron-electromagnetostatic cells of the present technology.

FIG. 9 illustrates a series of ECD cells and ion traps operating together to enable multiple levels of precursor selection and fragmentation to be carried out. Ion traps 902, 904 and 906 are alternately placed with ECD cells 908 and 910. First ECD cell 908 includes an electron emitting filament 912, a first magnet 914 on the right side of the electron emitting filament 912, a second magnet 916 on the left side of the electron emitting filament 912, a first end cap lens 918 on the right side of the first magnet 914 (the side opposite the electron emitting filament 912), a second end cap lens 920 on the left side of second magnet 916 (the side opposite the electron emitting filament 912). Second ECD cell 910 includes an electron emitting filament 922, a first magnet 924 on the right side of the electron emitting filament 922, a second magnet 926 on the left side of the electron emitting filament 922, a first end cap lens 928 on the right side of the first magnet 924 (the side opposite the electron emitting filament 922), a second end cap lens 930 on the left side of second magnet 926 (the side opposite the electron emitting filament 922).

As shown, ion packets from a mass spectrometer ion source from left to right in the direction of arrow 932. The ion trap 902 may be operated to selectively eject precursor ions to produce fragments that are trapped in ion trap 904. A fragment that is too large to identify may be further selected for further fragmentation in the ECD cell and collection in the third ion trap 906. The process may be continued to allow the analysis of macromolecular complexes that are too large for direct analysis by current mass analyzers.

ECD Fragmentation of Substance P

Figure 10:
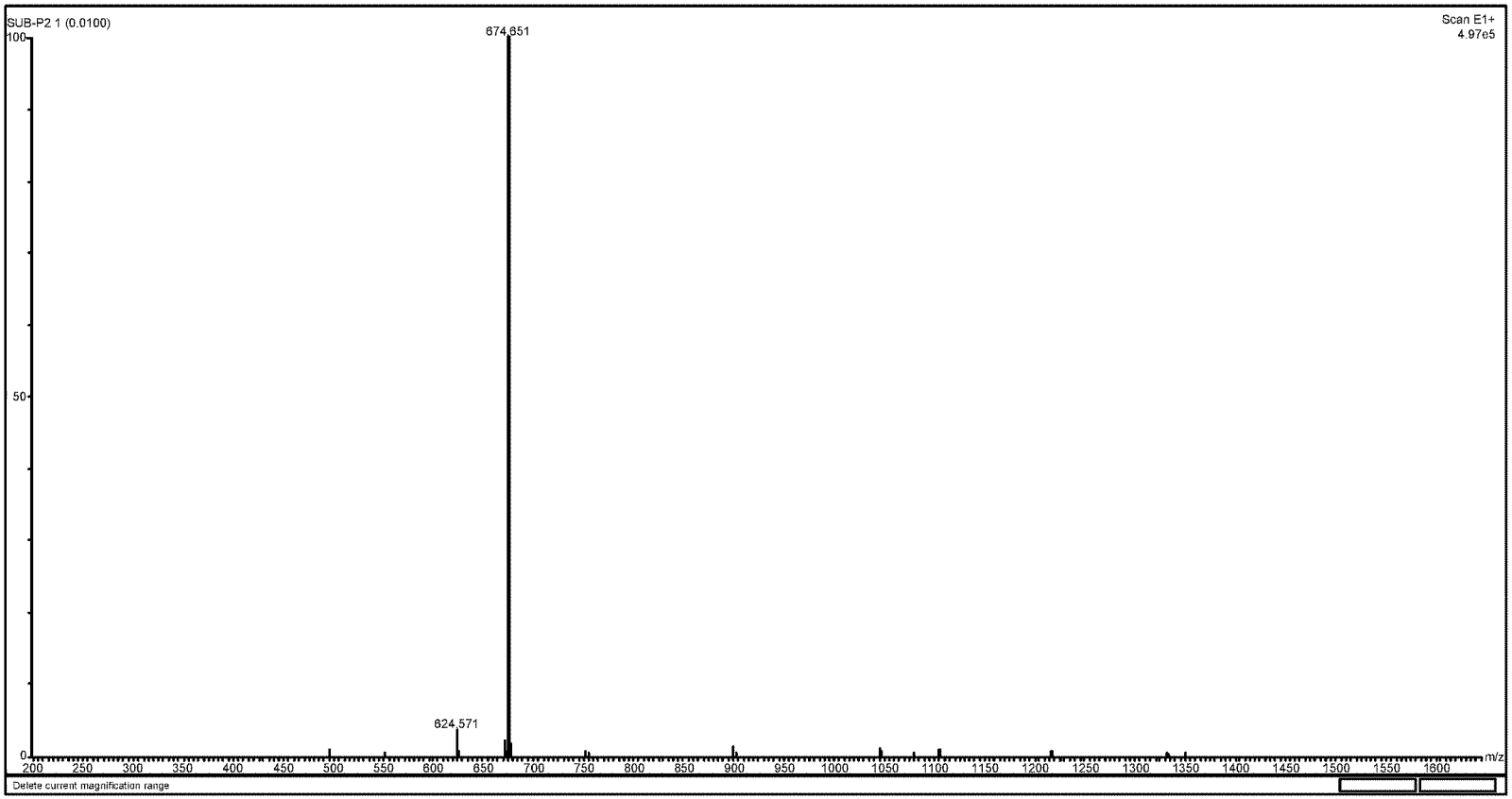
FIG. 10 illustrates an ECD spectrum for Substance P as measured with a single pass ECD cell on a modified Sciex Q-ToF.
Figure 11:
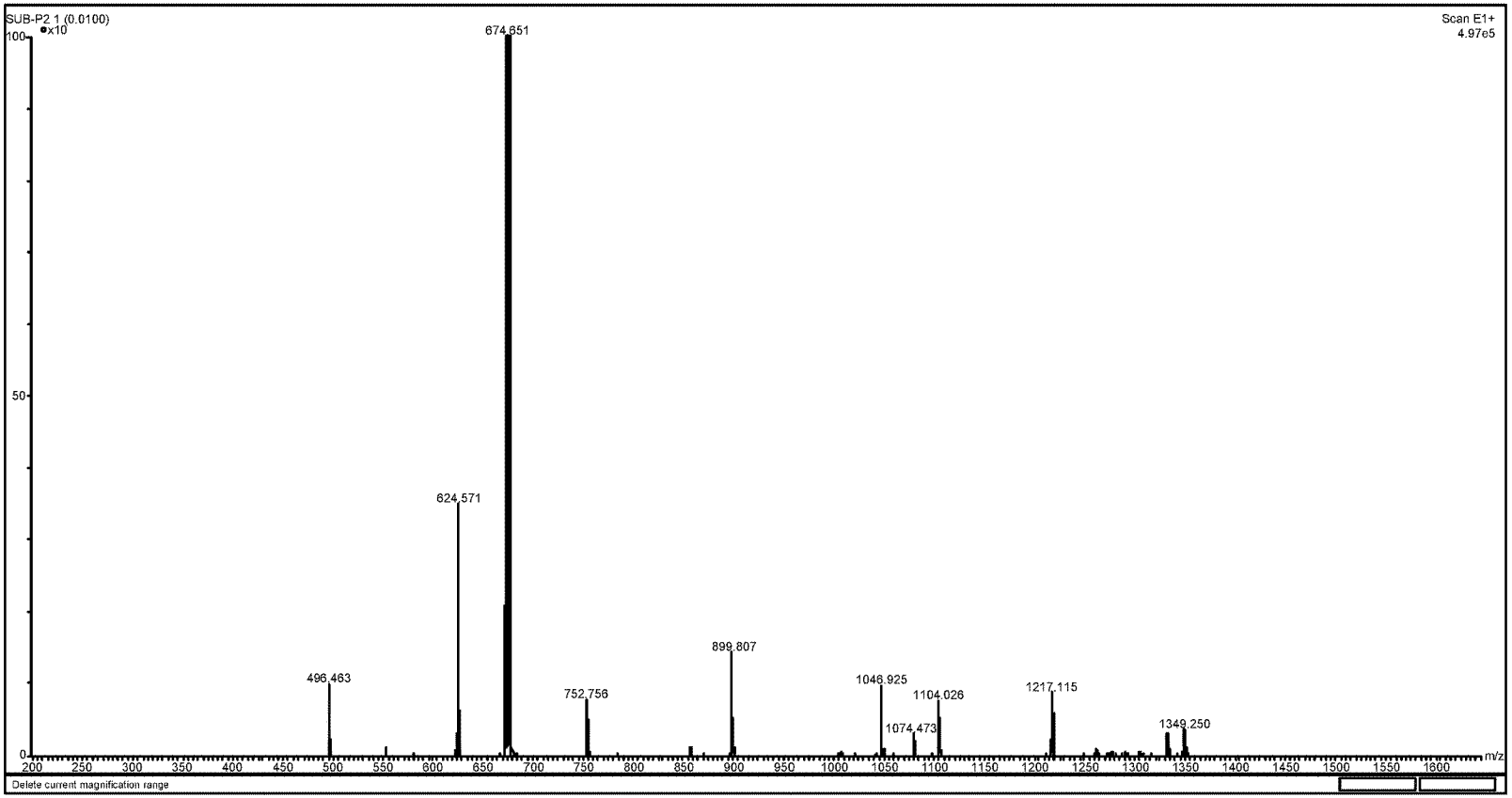
FIG. 11 illustrates an enlargement of a first portion of the spectrum of FIG. 10.
Figure 12:
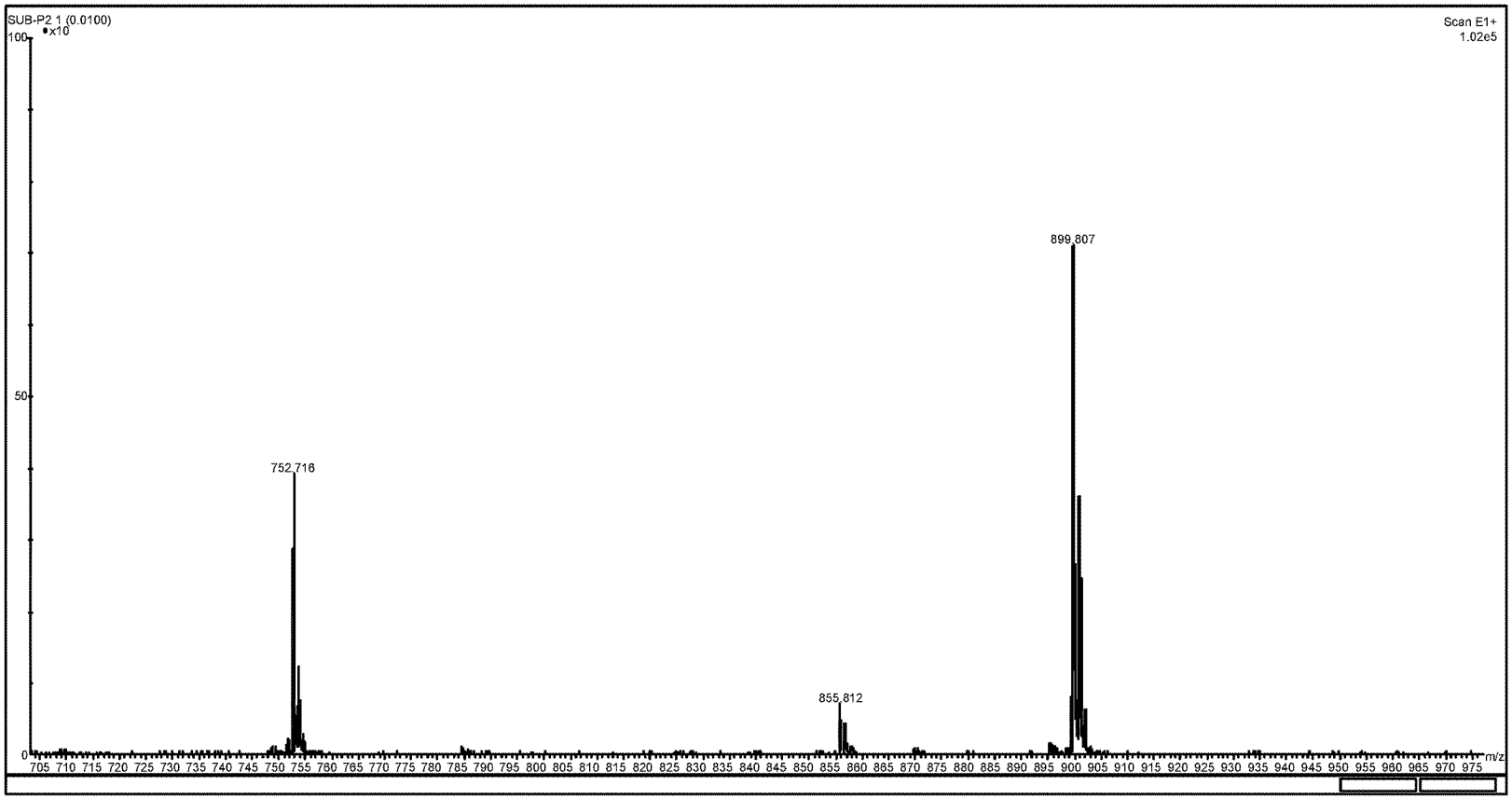
FIG. 12 illustrates an enlargement of a second portion of the spectrum of FIG. 10.

Substance P is an eleven amino acid peptide and naturally occurring hormone that has become widely used as a standard for evaluating ECD fragmentation. Hence, substance P is well known to a tough peptide to fragment by ECD, which is why it is used as a standard for ECD experiments. FIG. 10 shows the ECD spectrum for Substance P as measured with a single pass ECD cell on a modified Sciex Q-ToF. The major peak is at 674 m/z and is the unfragmented doubly charged precursor peptide. Enlargements of the spectrum are provided in FIGS. 11 and 12 to show that the small peaks from ECD are clearly resolved while CID peaks are absent.

Figure 13:
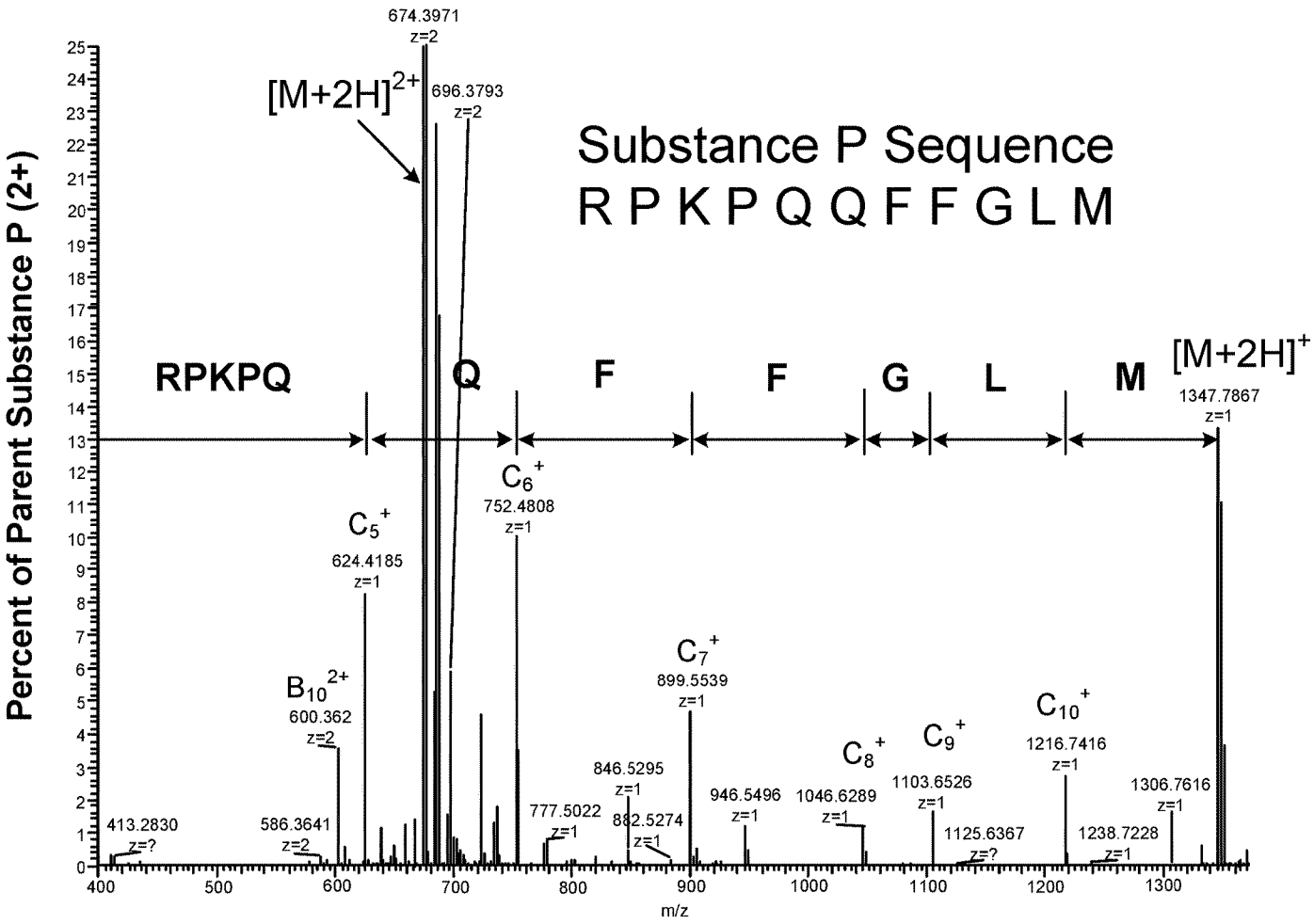
FIG. 13 illustrates an ECD spectrum from a modified mass analyzer operated in a dual ion trap mode, where the substance P peptide is passed through the ECD twice.

FIG. 13 shows an ECD spectrum from a modified mass spectrometer operated in a dual ion trap mode, where the substance P peptide is passed through the ECD twice. The C5 and C6 ions are each about 10% of the parent Substance P intensity. There are a number of other CID peaks present at low intensity. Finally, about 13% of the parent Substance P had captured one electron and becomes singly charged [M+2H]+. This is called ECnoD, but provides useful information. These peaks are clearly present in single scans, showing that the fragmentation is efficient and exceptionally fast (estimated to occur in about 10 microseconds) and thus does not slow the duty cycle of the mass spectrometer.

Figure 14:
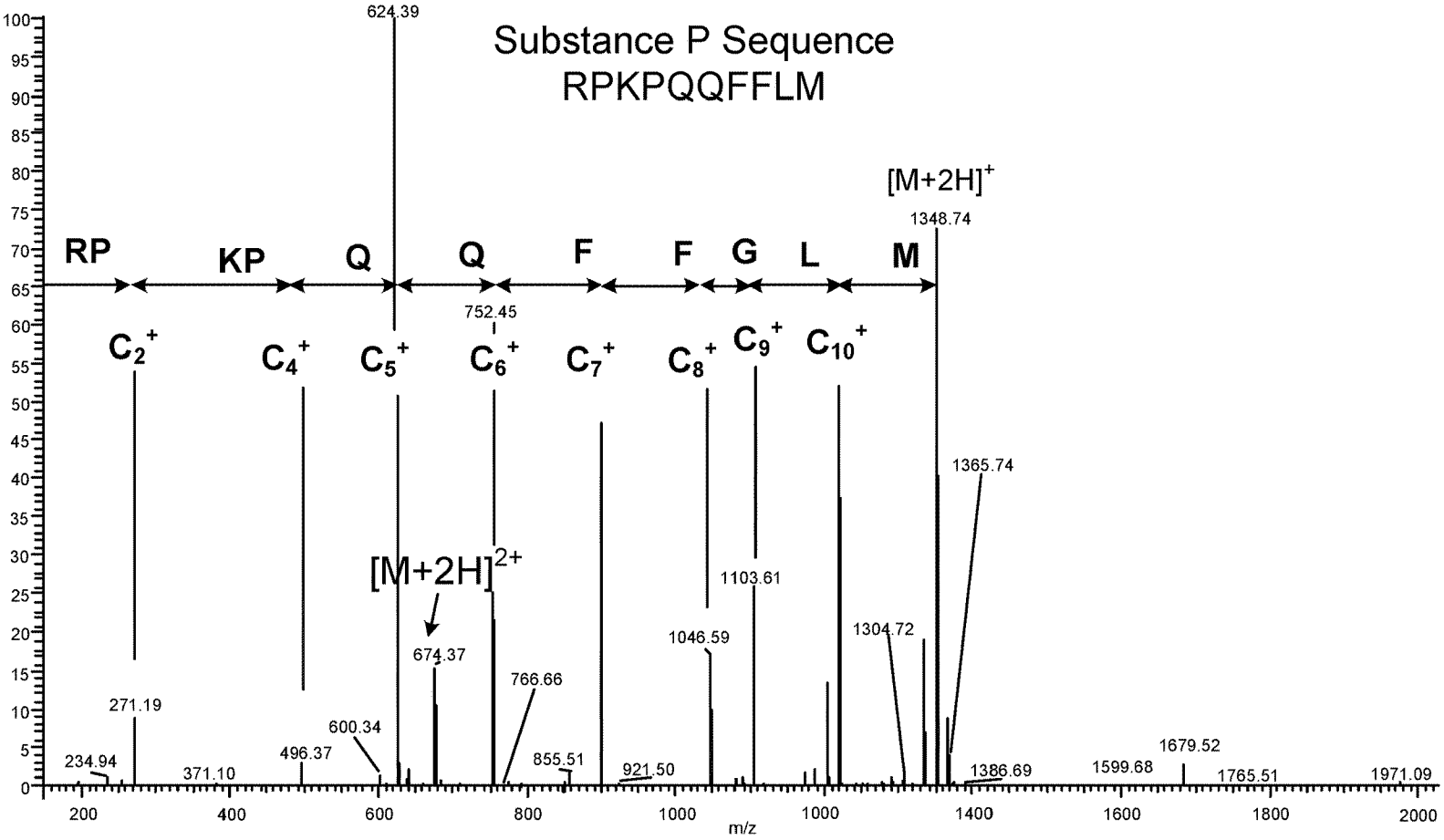
FIG. 14 illustrates an ECD spectrum of Substance P operated in reflectron mode with one ion trap on a mass analyzer.

FIG. 14 shows an ECD spectrum of Substance P operated in reflectron mode with one ion trap on a mass analyzer. This spectrum is very clean, quite intense, and is the first spectrum with the C2 being identifiable. The B10(2+) CID fragment is very small, which is quite unusual. Finally, the parent substance P ion is only 15% of the signal and C5 is the most intense peak in the spectrum. There is a chance that the low signal intensity for substance P(2+) is an artifact of the way the reflectron is operating (it may have been preferentially scattered or lost).

ECD Fragmentation of Phosphopeptides

Figure 15:
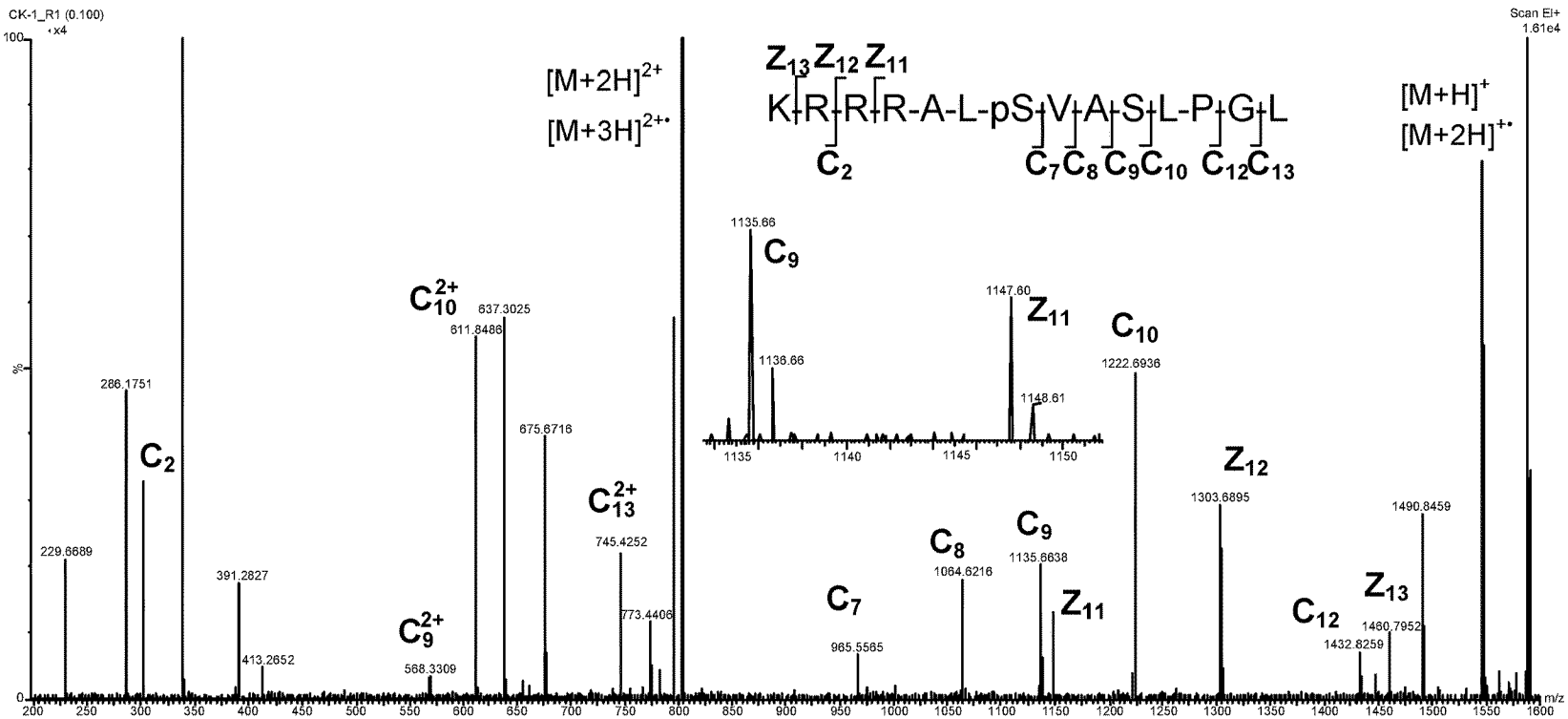
FIG. 15 illustrates an ECD spectrum of a phosphopeptides from the reflectron mode.

FIG. 15 shows an ECD spectrum of a phosphopeptides from the reflectron mode. This spectrum shows that the fragile phosphoserine modification is retained in our ECD cell.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A reflectron-electromagnetostatic cell comprising:

a thermo electron emitter;

a first magnet on a first side of the thermo electron emitter, and a second magnet on a second side of the thermo electron emitter;

a first ion control element comprising at least one reflectron having at least one electrostatic element, the first ion control element located on a side of the first magnet opposite the thermo electron emitter; and a voltage controller operatively connected to the first ion control element, wherein the controller automatically adjusts voltages of the at least one electrostatic element to control the flight path of ions through the reflectron-electromagnetostatic cell, the voltage controller configured to establish a first voltage gradient across the at least one reflectron that reflects the ion packet through the thermo electron emitter a second time after the ion packet passes through the thermo electron emitter a first time.

2. The reflectron-electromagnetostatic cell of claim 1, wherein a reflectron from among the at least one reflectron comprises at least one electrostatic lens.

3. The reflectron-electromagnetostatic cell of claim 1, wherein a reflectron from among the at least one reflectron comprises a plurality of electrostatic lenses.

4. The reflectron-electromagnetostatic cell of claim 1, wherein a reflectron from among the at least one reflectron comprises an ion trap.

5. The reflectron-electromagnetostatic cell of claim 1, wherein the voltage controller is operable to adjust a direct current (DC) voltage of any electrostatic element of a reflectron from among the at least one reflectron in the range of −100 to +100 volts within the timescale of microseconds.

6. The reflectron-electromagnetostatic cell of claim 1, further comprising a second ion control element, the second ion control element comprising at least one reflectron having at least one electrostatic element, the ion control element located on a side of the second magnet opposite the electron emitter.

7. The reflectron-electromagnetostatic cell of claim 6, wherein the voltage controller is operatively connected to the first ion control element and the second ion control element, and wherein the controller automatically adjusts voltages of the at least one electrostatic element of the first ion control element and the at least one electrostatic element of the second ion control element to control the flight path of ions through the reflectron-electromagnetostatic cell, the voltage controller is configured to:

establish a first voltage gradient across the at least one reflectron of the first ion control element that reflects the ion packet through the thermo electron emitter a second time after the ion packet passes through the thermo electron emitter a first time; and establish a second voltage gradient across the at least one reflectron of the second ion control element that reflects the ion packet through the thermo electron emitter a third time.

8. The reflectron-electromagnetostatic cell of claim 7, wherein the voltage controller is configured to adjust the voltage gradient in the first ion control element, after the ion packet has passed through the thermo electron emitter at least the third time, to allow the ion packet to exit the reflectron-electromagnetostatic cell.

9. The system of claim 1, wherein each of the at least one electrostatic element is distinctly controlled to have a particular voltage by the voltage controller.

10. A method of operating a reflectron-electromagnetostatic cell, the method comprising steps of:

providing an ion packet into a reflectron-electromagnetostatic cell, the reflectron-electromagnetostatic cell comprising:

a thermo electron emitter;

a first magnet on a first side of the thermo electron emitter, and a second magnet on a second side of the thermo electron emitter;

a first ion control element comprising at least one reflectron having at least one electrostatic element, the ion control element located on a side of the first magnet opposite the thermo electron emitter; and a voltage controller operatively connected to the first ion control element, wherein the voltage controller automatically adjusts voltages of the at least one electrostatic element to control the flight path of ions through the reflectron-electromagnetostatic cell;

passing the ion packet through the thermo electron emitter a first time; and establishing a first voltage gradient across the reflectron using the voltage controller that reflects the ion packet through the thermo electron emitter a second time.

11. The method of claim 10, wherein the reflectron-electromagnetostatic cell further comprises a second ion control element, the second ion control element comprising at least one reflectron having at least one electrostatic element operatively connected to the voltage controller, the second ion control element located on a side of the second magnet opposite the electron emitter, the method further comprising a step of:

establishing a second voltage gradient across the second ion control element using the controller that reflects the ion packet back through the electron emitter a third time.

12. The method of claim 11, further comprising a step of:

adjusting the voltage gradient in the first ion control element using the voltage controller, after the ion packet has passed through the thermo electron emitter at least the third time, to allow the ion packet to exit the reflectron-electromagnetostatic cell.

13. The method of claim 10, wherein each of the at least one electrostatic element is distinctly controlled to have a particular voltage by the voltage controller.

* * * * *